US005491980A

United States Patent [19]

Yingst et al.

[11] Patent Number: 5,491,980

[45] Date of Patent: Feb. 20, 1996

[54] REVERSIBLE REFRIGERATOR/FREEZER SYSTEM

[75] Inventors: Thomas E. Yingst; Gerald J. Stensrud, both of Bedford; Ronald S. Davis, Euless, all of Tex.

[73] Assignee: Traulsen & Co. Inc., A Delaware Corporation, College Point, N.Y.

[21] Appl. No.: 302,280

[22] Filed: Sep. 8, 1994

[51] Int. Cl.[6] ..... F25D 15/00

[52] U.S. Cl. ..... 62/237; 62/258; 62/298

[58] Field of Search ..... 62/298, 258, 285, 62/290, 291, 237

[56] References Cited

U.S. PATENT DOCUMENTS

| | | | |
|---|---|---|---|
| 2,414,588 | 1/1947 | Elliott | 62/237 |
| 2,914,927 | 12/1959 | Corhanidis | 62/237 X |
| 3,712,078 | 1/1973 | Maynard et al. | 62/448 |
| 4,457,140 | 7/1984 | Rastelli | 62/285 X |
| 4,549,405 | 10/1985 | Anderson et al. | 62/298 X |
| 4,698,982 | 10/1987 | Laois et al. | 62/298 X |
| 4,723,418 | 2/1988 | Whitmer, II | 62/298 |
| 4,802,340 | 2/1989 | Johnson | 62/258 X |
| 4,805,418 | 2/1989 | Ishizuka et al. | 62/298 |
| 4,901,538 | 2/1990 | Anthony | 62/237 |
| 4,934,255 | 6/1990 | McDonnell et al. | 62/237 X |
| 5,277,036 | 1/1994 | Dieckmann et al. | 62/298 X |

*Primary Examiner*—William E. Tapolcai
*Attorney, Agent, or Firm*—S. C. Yuter

[57] ABSTRACT

A refrigerator system having a refrigerating mechanism packaged in a separate case from the refrigerated cabinet and adapted to be attached to either side of the refrigerated cabinet. The refrigerated cabinet has discharge and return openings on each of opposite sides. The refrigerating mechanism has matching discharge and return openings on each of opposite sides. The discharge and return openings on the unattached side of the refrigerating mechanism and refrigerated cabinet are covered. The refrigerating mechanism has an evaporator blower which draws warm air through the return opening in the attached refrigerated cabinet, then through a cooling evaporator coil to propel the cooled air into a blower plenum, and then out a discharge outlet of the blower plenum directly into the matching discharge opening in the adjacent refrigerated cabinet. A removable counter top matches and is attached to the top of the refrigerated cabinet, with its top surface in the same plane as the top surface of the refrigerating mechanism. The refrigerating mechanism also has a compressor and condenser cooling system combined with a system for removing water condensed on the evaporator coil of the refrigerating mechanism.

21 Claims, 5 Drawing Sheets

REVERSIBLE REFRIGERATOR/FREEZER SYSTEM

BACKGROUND OF THE INVENTION

1. Field of the Invention

This invention relates to refrigerator/freezer systems, and more particularly to such systems for use below working counters, especially in restaurants.

2. Description of the Related Art

Heretofore the refrigerating mechanism of a refrigerator/freezer system (hereinafter jointly "refrigerator system") has been constructed as an integral part of the refrigerated cabinet assemblage. That integrated refrigerator construction sometimes limited the adaptability of the refrigerator system, especially for use in restaurants beneath working counters. It also sometimes required that the refrigerating mechanism be serviced at its location even though major repairs could be more conveniently made at a service center.

SUMMARY OF THE INVENTION

The general object of the present invention is to provide an improved refrigerator system.

A more specific object of the invention is to provide a refrigerator system which is especially adaptable for use below a working counter in the kitchen, preparation or serving area of a restaurant.

A further object of the invention is to provide a below counter refrigerator system which is flexible in installation design and changeable in the restaurant.

A still further object of the invention is to provide a refrigerator system in which major repairs of the refrigerating mechanism alone can be made at a service center.

Briefly, in accordance with the invention, a refrigerator system is provided in which the refrigerating mechanism is packaged in a separate case from the refrigerated cabinet and is adapted to be attached to either side of the refrigerated cabinet. The refrigerated cabinet has discharge and return openings on each of its sides. The refrigerating mechanism has matching discharge and return openings on each of its sides. The discharge and return openings on the free (unattached) side of the refrigerating mechanism and refrigerated cabinet are covered.

An advantage of the invention is that the separately encased refrigerating mechanism may be removed prior to moving the cabinet through a passage way which is too small for the entire refrigerator system.

Still another advantage of the separately encased refrigerating mechanism is that it is compact, and separately to specialty sheet metal builders that build refrigerated cabinets but do not have the ability to provide the refrigerating mechanism for their built-in cabinetry.

A feature of the invention is an evaporator blower which draws warm air through a return opening in the attached refrigerated cabinet via a matching return opening in the side panel of the refrigerating mechanism case, then through a cooling evaporator coil to propel the cooled air into a blower plenum, and then ,out a discharge outlet of the blower plenum and through a matching discharge opening in the side panel of the refrigerating mechanism case directly into a matching discharge opening in the adjacent refrigerated cabinet. The blower plenum has discharge outlets on opposite sides which match discharge openings in the opposite side panels of the refrigerating mechanism case. The refrigerated cabinet also has matching discharge and return openings on opposite sides. Thus the separately encased refrigerating mechanism can be attached on either side of the refrigerated cabinet. The discharge opening on the free side panel of the refrigerating mechanism case is covered, as is its return opening on that side. The discharge opening on the free side of the refrigerated cabinet is covered, as is its return opening on that side.

Another feature of the invention is a removable counter top that matches the top of the refrigerated cabinet and is manufactured separately and then attached to the top of the refrigerated cabinet, with its top surface in the same plane as the top surface of the refrigerating mechanism, after all interior duct work, shelving amid drawers has been accomplished.

An advantage of the removable counter top feature is that it permits separate types of counter tops to be included in the final assemblage, for example for pizza preparation tables or delicatessen tables, which have different types of condiment containment devices. Because the counter tops are removable, different size openings in different locations can be cut in the counter top at the restaurant site for different condiment needs.

Another advantage of the removable top feature is that it also functions to heat insulate the top of the refrigerated cabinet.

A further feature of the invention is a compressor and condenser cooling system combined with a system for removing water condensed on the evaporator coil of the refrigerating mechanism. The refrigerating mechanism has evaporator and compressor sections separated by a thermal insulation wall. An evaporator condensate pan is mounted beneath the evaporator coil in the evaporator section to collect water condensed on the outside of the evaporator coil. A compressor section condensate pan is mounted below the compressor in the compressor section. A condensate tube conducts the condensate in the evaporator condensate pan through the thermal insulation wall to the compressor section condensate pan. A condenser coil and condenser fan are mounted adjacent and over the compressor at an angle of substantially 45° with the horizontal. The compressor section is enclosed on all sides except for a front panel having a top opening and a bottom opening. The condenser fan forces air drawn through the top opening of the front panel, through the condenser coil to cool the condenser coil and warm the forced air, around the compressor to cool the compressor and further warm the forced air, then over the condensate in the compressor section condensate pan to evaporate the condensate, and then expel the evaporated condensate out the bottom opening of the front panel.

An advantage of this feature of the invention is evaporation of the condensate moisture is accelerated without requiring electrical heaters on submerged condenser tubes in the compressor section condensate pan.

Other objects, features and advantages of the invention and its features will be apparent from the following detailed description of the preferred embodiment of the invention taken together with the accompanying drawings.

BRIEF DESCRIPTION OF THE DRAWINGS

FIG. (FIG.) 1 is an isometric view of a refrigerator system, in accordance with the preferred embodiment of the invention, showing the separately encased refrigerating mechanism removably attached to the right side of the refrigerated cabinet, and the removable counter top feature of the invention in an exploded view.

FIG. 5 shows three side elevational views of the evaporator blower of FIG. 2.

In the various figures of the drawings like reference characters designate like parts.

DESCRIPTION OF THE PREFERRED EMBODIMENT

Figure 1:
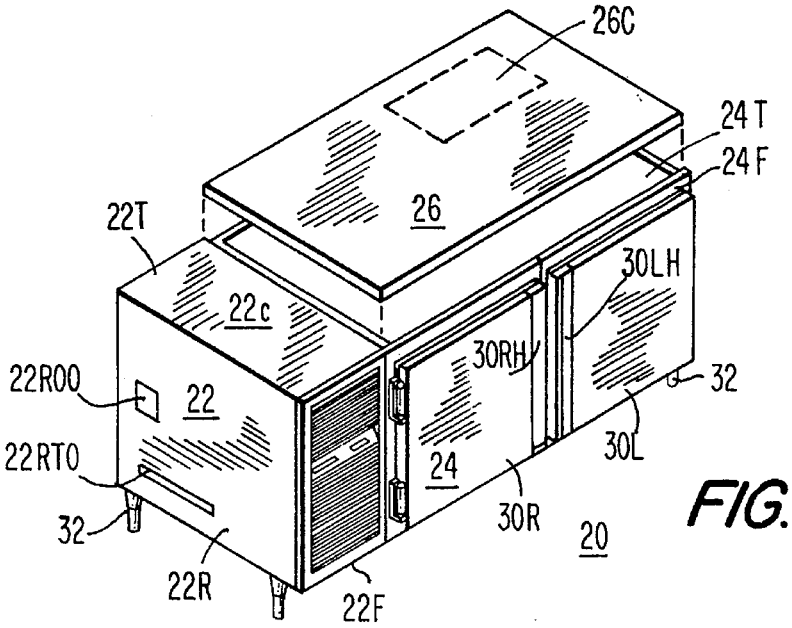

Referring to FIG. 1 of the drawings, there is shown a reversible refrigerator system 20 comprising a separately encased refrigerating mechanism 22 which is removably attached to a separately encased refrigerated cabinet 24 which has a removable counter top 26. The top surface of the removable counter top 26 is in the same plane as the top surface of the refrigerating mechanism 22. The refrigerator system 20 is especially useful as a work counter in the kitchen, preparation area or serving area of a restaurant.

Refrigerating mechanism 22 (FIGS. 1–4) has a front panel 22F, a right panel 22R, a top panel 22T, a left panel 22L, a back panel 22BK and a bottom panel 22BT which, together with panels 22F, 22R and 22T, completely encase the refigerating mechanism 22.

Right panel 22R (FIG. 1) has a discharge opening 22RDO and a return opening 22RTO. A stainless steel panel, called a vanity skirt because it fully covers right panel 22R and thus the discharge opening 22RDO and return opening 22RTO, is not shown.

Refrigerated cabinet 24 (FIGS. 1–4) has a front panel 24F, top panel 24T, right panel 24R, left panel 24L, back panel 24BK and bottom panel 24BT, which together completely encase the refrigerated cabinet. Doors 30R and 30L are mounted in corresponding openings in front panel 24F of refrigerated cabinet 24 to access the inside of the refrigerated cabinet 24. Door 30R has a recessed handle 30RH along its opening side and Door 30L has a recessed handle 30LH along its opening side.

The top panel 22T (FIG. 1) of the refrigerating mechanism 22 has a height which exceeds the height of the top panel 24T of the refrigerated cabinet 24 by the thickness of the removable counter top 26 so that the top surface of the removable counter top 26, when attached, is in the same plane as the top surface of the refrigerating mechanism 22 to provide a common work surface.

The removable counter top 26 is connected by screws (not shown) to top panel 24T of refrigerated cabinet 24. Shown in dotted outline as 26C is an opening for a condiment tray, which can readily be made at the restaurant site. The construction of removable counter top 26 will hereinafter be described in greater detail.

Legs 32 (FIG. 1) on the outside corners of refrigerator mechanism 22 and refrigerated cabinet 24 (three are shown) support the refrigerator system 20. Legs 32, which are attached at the restaurant site, are preferably mounted on rollers.

As hereinafter explained in greater detail, refrigerating mechanism 22 can be attached to either the right side of refrigerated cabinet 24, as shown, or to the left side of refrigerated cabinet 24.

The refrigerating mechanism 22 can be attached to one side of the refrigerated cabinet 24 at the factory, or shipped separately to a restaurant for attachment at the site, or switched from one side to the other at the site.

The refrigerating mechanism 22 can also be supplied separately for use by refrigerator system cabinet makers.

Figure 3:
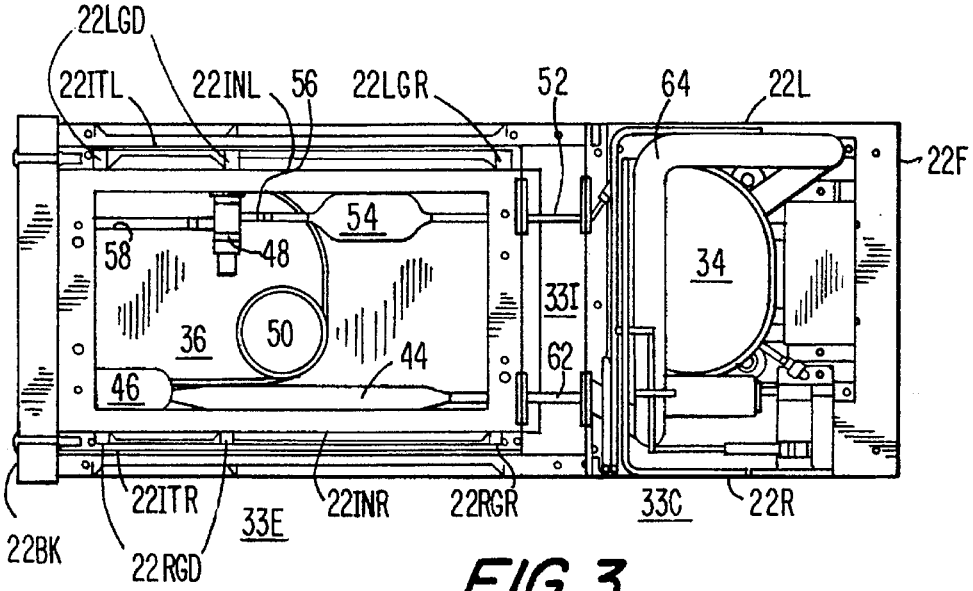
FIG. 3 is a top view of the refrigerating mechanism of FIG. 2 taken just below the evaporator blower of the evaporator section and looking through the evaporator coil (shown partially cross hatched) to beneath its underside, and on the compressor section side looking at the top of the compressor.
Figure 2:
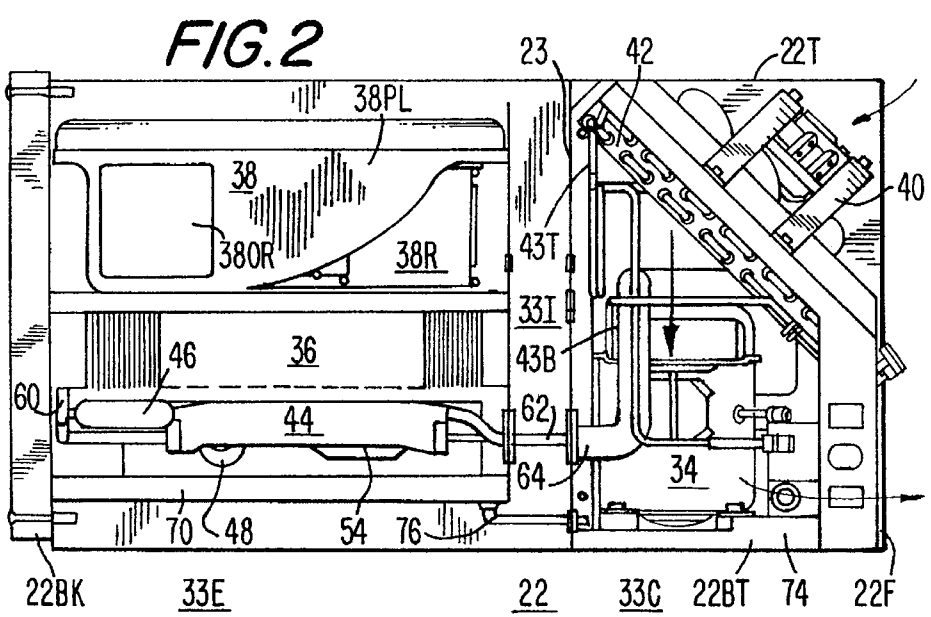
FIG. 2 (just below FIG. 3) is a side elevational view of the refrigerating mechanism of FIG. 1 with the side panel of its case removed, and especially showing the evaporator section on the left side with the evaporator blower and its discharge opening on one side of the evaporator blower. The arrows in the compressor section on the right side show the direction of the forced air of the combined compressor and condenser cooling and condensate removal system.

Referring to FIGS. 2 and 3, the refrigerating mechanism 22 comprises an evaporator section 33E at the left and a compressor section 33C at the right separated by thermal insulation wall 33I.

Evaporator section 33E (FIG. 2) has an evaporator coil 36, an evaporator blower 38, an accumulator 44 and an insulated sensing bulb 46 which is connected to a thermal expansion valve (TXV) 48 (FIG. 3) via a coiled capillary tube 50. The cross hatching on the evaporator coil 36 (Fig. 2) represents fins.

Compressor section 33C (FIG. 2) has a compressor 34, a condenser fan 40 and a condenser coil 42. The condenser fan 40 and condenser coil 42 are mounted adjacent and over the compressor 34 at a substantially 45° angle with the horizontal.

Compressed refrigerant gas under high pressure from the compressor 34 is fed to the top of the condenser coil 42 via tube 43T and exits from the bottom of condenser coil 42 via tube 43B as a high pressure liquid. The high pressure liquid refrigerant is fed via tube 52 (FIG. 3), which passes through thermal insulation wall 33I, to the filter drier 54, in turn connected by tube 56 to the thermal expansion valve 48. Tube 58 connects the outlet of thermal expansion valve 48 to the inlet of evaporator coil 36.

The outlet of the evaporator coil 36 (FIG. 2) is connected by tube 60 to the inlet of the insulated sensing bulb 46 whose outlet is connected to the inlet of accumulator 44 whose outlet is connected by tube 62, which passes through thermal insulation wall 33I, to an insulated suction line 64 (FIG. 3) connected to the inlet of compressor 34.

Figure 4:
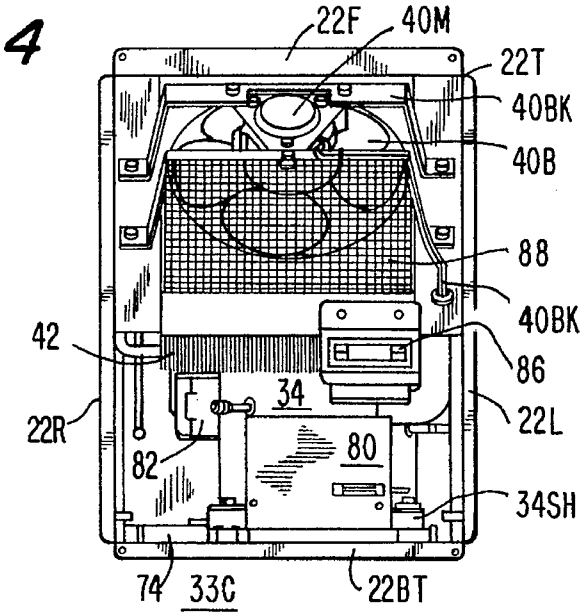
FIG. 4 is a side elevational view of the front of the refrigerating mechanism of FIG. 2 with the front panel removed, and especially showing the condenser fan, condenser coil and compressor.

An evaporator condensate pan 70 (FIG. 2) is mounted beneath the evaporator coil 36 to collect water condensed on the outside of the evaporator coil 36. A compressor section condensate pan 72 is mounted below the compressor 34. A condensate tube 76 conducts the condensate in the evaporator condensate pan 70 through the thermal insulation wall 33I to the compressor section condensate pan 74 (FIGS. 2 and 4)

The compressor section 33C (FIG. 4) also includes a master junction box 80 which houses most of the electrical connections of the refrigerating system 22, a smaller compressor junction box 82 for the electrical connections for the compressor 34 and an electronic control unit 86 for controlling the refrigerating mechanism 22. A screen 88 mounted over the condenser fan 40 prevents the entry of a finger into the fan blades 40B of the condenser fan 40. Brackets 40BK support the motor 40M of the condenser fan 40. The compressor 34 is mounted on four shock absorbers 34SH connected via brackets to the bottom panel 22BT.

The electronic control unit 86, in which the temperature parameters of the refrigerating mechanism 22 are set, controls the compressor 34 and condenser fan 40 motors and turns on the evaporator blower motor 38M, which remains on during the operation of the refrigerating mechanism 22.

The compressor section 33C (FIG. 4) is fully enclosed by the right panel 22R, the left panel 22L, the front panel 22F, the bottom panel 22BT, the top panel 22T and a rear panel 23 (FIG. 2) adjacent the insulating wall 33I. Tubes 62 and 76 pass through insulating wall 33I and grommets in rear panel 23. The front panel 22F (FIG. 1) has vertical louvers which permit the passage of air in and out of the refrigerating mechanism 22.

The heat from the compressor 34 (FIG. 2) and the heat generated in the condenser coil 42 is exhausted from the encased refrigerating mechanism 22 into the surrounding air together with condensate in compressor section condensate pan 72 by a forced air stream produced by the condenser fan 40.

The direction of the forced air stream in the fully enclosed compressor section 33C is shown by three arrows in FIG. 2. Ambient air from outside the refrigerating mechanism 22 is drawn through the upper louvers of front panel 24, then through the condenser coil 42, to cool the condenser coil 42 while heating the forced air, then around the compressor 36, to cool the compressor 36 while further heating the forced air to a temperature in the range of 140° F.–160° F., then over the evaporator condensate in the compressor section condensate pan 74, and is expelled out of lower louvers of front panel 24 back into the ambient air. The power and speed of the condenser fan 40 produces a forced air stream in the range of 350 to 450 cubic feet per minute. In that way evaporator condensate in the compressor section condensate pan 74 is removed and expelled with the forced air from the compressor section 33C without the need for electrical heaters within the second evaporator condensate pan 74.

The refrigerant is refrigerant 134*a*.

The high pressure liquid refrigerant passes through the expansion valve 48 (FIG. 3), which lowers the pressure of the liquid refrigerant, which then expands into a low pressure vapor in the evaporator coil 36 (FIG. 2), thus extracting heat from the evaporator coil 42 making it very cold. The refrigerant as a low pressure gas is then compressed into a a very dense gas by the compressor 34 and then condensed into a liquid in the condenser coil 42, where it expels the heat absorbed into the refrigerant by the evaporator coil 36. The liquid refrigerant then at high pressure is returned to the thermal expansion valve 46 and evaporator coil 42 to repeat the refrigerating cycle. Warm air exhausted from the adjacent refrigerated cabinet 24 passes over and is cooled by the evaporator coil 42 and then returned to the refrigerated cabinet 24 to keep it cold.

More particularly, a low pressure refrigerant gas and liquid mixture exits the evaporator coil 36 (FIG. 2) and, via the insulated sensing bulb 46, accumulates in the accumulator 44. The low pressure refrigerant mixture is then returned to the compressor 34 to be compressed and then condensed by the condenser 42 into a high pressure liquid refrigerant. The liquid refrigerant is then filtered and dried by the filter drier 54 (FIG. 3) and then fed to the thermal expansion valve 48.

The insulated sensing bulb 46 controls the thermal expansion valve 48 via the capillary tube 50. The insulated sensing bulb 46, in response to the temperature of the evaporator coil 36, meters or modulates a diaphragm in the thermal expansion valve 48 to open it, control the size of the opening and close it, depending on the temperature, thus controlling the amount of expansion of the refrigerant in the evaporator coil 36.

The accumulator 44 (FIG. 2) provides a storage place for the refrigerant. Normally, the refrigerating mechanism 22 tries to maintain the temperature inside the refrigerated cabinet 24 at about 38° F. But if the temperature in the cabinet 24 suddenly rises, for example by placing a pot of hot soup in it, the air drawn from the cabinet 24 into the refrigerating mechanism 22 and through the evaporator coil 36 suddenly heats up. That increases the temperature of the evaporator coil 36 causing low pressure liquid refrigerant in the evaporator coil 36 to gasify and the accumulator 44 takes up the slack, and that protects the compressor 34.

The evaporator blower 38 (FIG. 2) draws warm air from the inside of the refrigerated cabinet 24 (FIG. 1) into the encased refrigerating mechanism 22 and over the cold evaporator coil 42 and discharges the cold air back into the refrigerated cabinet 24 to refrigerate it.

The thermal expansion valve 46 (FIG. 2) is designed so that no liquid refrigerant will flow through it unless the pressure in the evaporator coil 36 is reduced by the running of the compressor 34. A compressor motor control thermocouple, not shown, is connected to the bottom of the evaporator coil 36 directly in the air stream and senses air temperature. When the temperature of the evaporator coil 36 has been reduced to the desired temperature, the compressor motor control turns off the compressor 34. When the compressor 34 is off, the compressor fan 40 is also off.

Figure 5L:
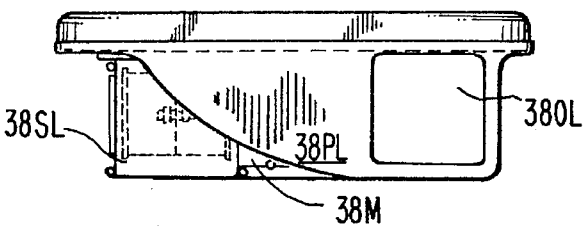
FIG. 5L shows the left side of the evaporator blower and its discharge opening on that side.
Figure 5E:
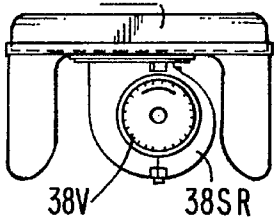
FIG. 5E shows an end view of the evaporator blower.
Figure 5R:
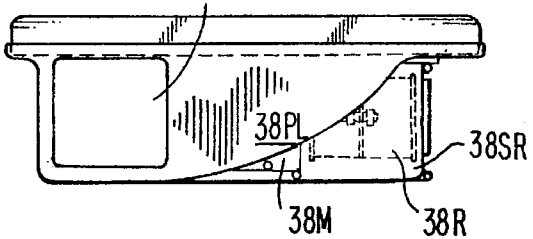
FIG. 5R shows the right side of the evaporator blower and its discharge opening on that side.

The evaporator blower 38 (FIGS. 2 and 5) comprises on a common shaft a centrifugal blower 38R and a centrifugal blower 38L with an intermediate electric motor 38M for rotating the centrifugal blowers 38R and 38L at high speed. That pulls warm air from the refrigerated cabinet 24 (Fig. 1) evenly across the evaporator coil 36 (FIG. 2) to cool the air. Each of the centrifugal blowers 38R and 38L (FIG. 5) is respectively mounted in a scroll 38SR and a scroll 38SL. Surrounding the centrifugal blowers 38R and 38L and motor 38M is an inverted U-shaped plenum 38PL. The wide end of each scroll 38S is connected to a similarly shaped opening on the inside top of plenum 38PL. On the outside of each side of the plenum 38PL is a discharge outlet 38OR and 38OL.

In operation, motor 38M turns the centrifugal blowers 38R and 38L at high speed. The vanes 38V of each centrifugal blower 38R and 38L draw warm air over the evaporator coil 36 to cool the air, which is then drawn through the rotating centrifugal blowers 38R and 38L into the associated scroll 38S, compressing the air in the narrow portion of the scroll and then expanding the air in the broader portion of the scroll. A forced cold air stream is thus discharged from one of two rectangular discharge outlets 38OR and 38OL on each glide of the plenum 38PL, the other of which is covered.

Each of the discharge outlets 38OL and 38OR is in registry with a matching opening 22RDO (FIGS. 1, 5 and 6, sheet 2) and 22LDO in the respective side panels 22R and 22L of the refrigerating mechanism 22.

Figure 6R:
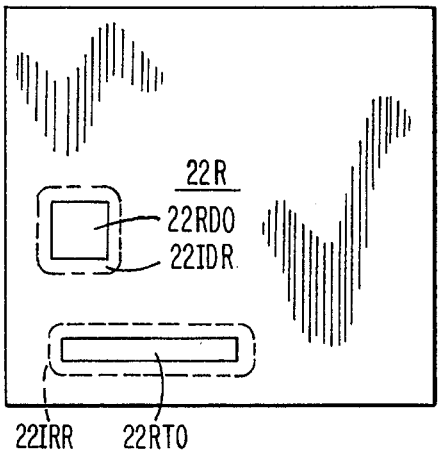
FIG. 6R (sheet 2) shows a side elevational view of the right side of the refrigerating mechanism of FIG. 1, and FIG. 6L the left side of the refrigerating mechanism, with their discharge and return openings.
Figure 6L:
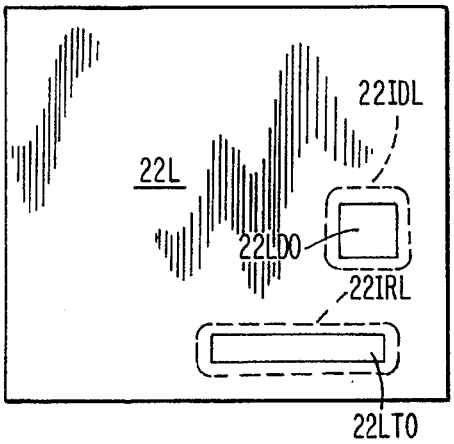

Referring to FIG. 6, the right panel 22R of the refrigerating mechanism 22 is shown in FIG. 6R and the left panel 22L in FIG. 6L. Right panel 22R (FIG. 6R) has the discharge opening 22RDO and return opening 22RTO. A doughnut-shaped foam seal 22IDR surrounds discharge opening 22RDO and a doughnut-shaped foam seal 22IRR surrounds return opening 22RTO. Left panel 22L (FIG. 6L) has a discharge opening 22LDO and a return opening 22LTO. A doughnut-shaped foam seal 22IDL surrounds discharge opening 22LDO and a doughnut-shaped foam seal 22IRL surrounds return opening 22LTO. A stainless steel vanity skirt, not shown, fully covers the free panel of the refrigerating mechanism 22 and thus the unused discharge and return openings.

Figure 7R:
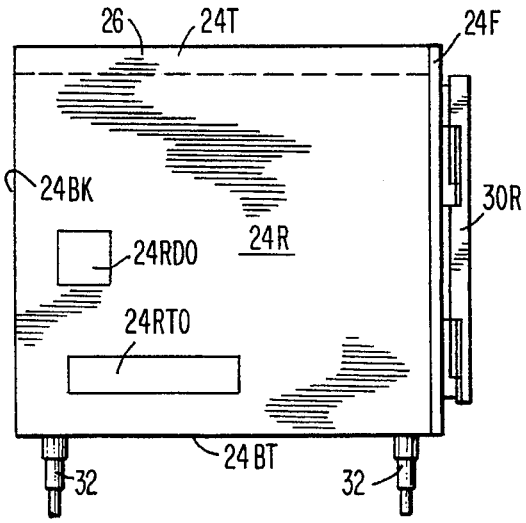
FIG. 7R shows a side elevational view of the right side of the refrigerated cabinet, and FIG. 7L the left side, each with its discharge and return openings.
Figure 7L:
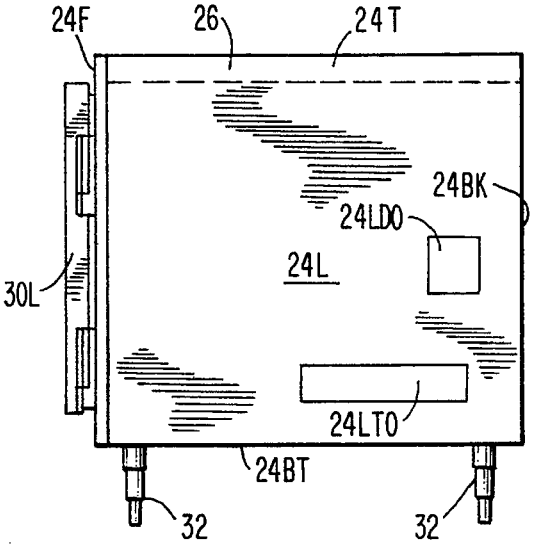

The right side of refrigerated cabinet 24 is shown in FIG. 7R and the left side in FIG. 7L. Shown in partially dotted outline at the top of refrigerated cabinet 24 is the removable top 26.

The right side panel 24R of the refrigerated cabinet 24 (FIG. 7R) has a discharge opening 24RDO and a return opening 24RTO. The left side panel 24L of the refrigerated cabinet 24 (FIG. 7L) has a discharge opening 24LDO and a return opening 24LTO. The unused discharge and return openings are blocked by insulating foam plugs, not shown, equal in thickness to the insulated cabinet wall and having an inside waterproof surface. A stainless steel vanity skirt, also not shown, fully covers the free panel of the refrigerated cabinet 24 and thus the unused discharge and return openings, except for the top section occupied by removable counter top 26.

Figure 8R:
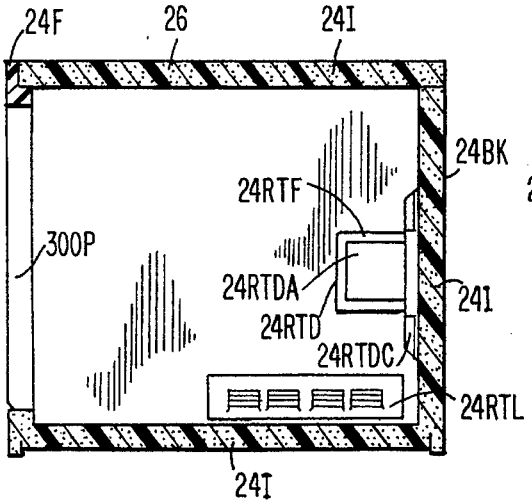
FIG. 8R shows a cross-sectional view taken from the inside of the refrigerated cabinet looking at the inside of its right side, and FIG. 8L from inside of the refrigerated cabinet looking at the inside of its left side.

FIG. 8R is a view from the inside of the refrigerated cabinet 24 looking at the inside of its right side when the refrigerating mechanism 22 is mounted on the right side of the refrigerated cabinet 24, as shown in FIG. 1. Discharge opening 24RDO (FIG. 7R) is covered by part of a transition duct 24RTD (FIG. 8R). Return opening 24RTO (FIG. 7R) is covered by a return opening louver 24RTL (FIG. 8R).

Figure 8L:
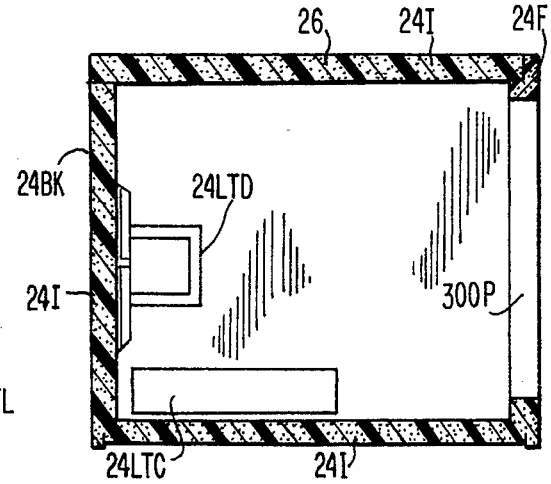

Transition duct 24RTD comprises a flange 24RTDF mounted over the discharge opening 24RDO (FIG. 7R), an angled conduit 24RTDA (FIG. 8R) connected at one end to the flange 24RTDF, and at the other end to a rectangular conduit 24RTDC mounted along the inside cabinet side wall, which conducts the cooled air from the refrigerating mechanism 22 via the discharge opening 24RDO (FIG. 7R) to the rear of the refrigerated cabinet 24 (FIG. 8L). Warmed air is returned to the refrigerating mechanism 22 via the return opening louver 24RTL and the return opening 24RTO (FIG. 7R).

FIG. 8L is a view from the inside of the refrigerated cabinet 24 looking at the inside of its left side when the refrigerating mechanism 22 is mounted on the right side of the refrigerated cabinet 24, as shown in FIG. 1. Discharge opening 24LDO (FIG. 7L) is covered by part of a transition duct 24LTD (FIG. 8L). Return opening 24LTO (FIG. 7L) is fully covered by a return opening cover 24LTC (FIG. 8L).

Transition duct 24LTD comprises a flange 24LTDF, an angled conduit 24LTDA connected at one end to the flange 24LTDF and at the other end to a rectangular conduit 24LTDC mounted along the inside cabinet side wall, which conducts the cooled air from the refrigerating mechanism 22 via the discharge opening 24LDO (FIG. 7L) to the rear of the refrigerated cabinet 24 (FIG. 8L). Warmed air is blocked from returning to the refrigerating mechanism 22 via the return opening cover 24LTC. And both the discharge opening 24LDO (FIG. 7L) and the return opening 24LTO is blocked by a stainless steel vanity skirt, not shown, fully covering the left side panel 24L except for the top section occupied by the removable counter top 26.

Refrigerated cabinet 24 is fully insulated by thermal insulation 24I except for the door openings 30OP, and the cabinet doors 30R and 30L (FIG. 1) are similarly thermally insulated. Similarly the evaporator section 33E (FIG. 2) of the refrigerating mechanism 22 is fully insulated along its internal periphery in addition to thermal insulation wall 33I. Rear panel 22BK is in a removable insulated wall panel and may be removed for servicing the evaporator section 33E. The front panel 22F (FIG. 1) is also removable for servicing the compressor section 33C (FIG. 2).

Figure 9:
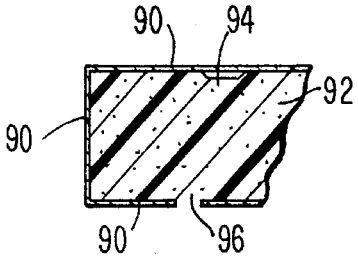
FIG. 9 (sheet one) is a cross-sectional view of one end of the removable counter top of FIG. 1.

The removable counter top 26 (FIGS. 1 and 9, first sheet) comprises a hollow parallel piped 90 made from sheet metal in the shape of the removable counter top 26 with the outside surface of the sheet metal galvanized and the inside surface stainless steel. A two-part foam is simultaneously pumped as liquids into the inside of the parallel piped and react inside to form a solid heat insulating foam 92. A sequence of flat screw head openings 94 along the outside top surface of the removable counter top 26 permit the removable counter top 26 to be screwed to the top panel 24T (FIG. 1) of the refrigerated cabinet 24.

A thermal break 96 in the bottom surface of the removable counter 24 helps block the transfer of heat between the stainless steel interior and the galvanized exterior. When the removable counter top 26 is screwed to the top panel 24T it closes off thermal break 96 so that there is no heat transfer from the removable counter top 26 to the refrigerated cabinet 24.

The refrigerating mechanism 22 (FIG. 10) is attached to the refrigerated cabinet 24 by bolt 100F near the front and bolt 100R near the rear of the refrigerator system 20. Two additional bolts are below bolt 100F and two additional bolts are below bolt 100R. Bolt 100F is screwed into a weld nut 102F mounted on an angle 104F and bolt 100R is screwed into a weld nut 102R mounted on an angle 104R. Prior to attachment, the angles 104 are held in place by the bolts 102 when a two-part foam 24I is blown into a chamber formed by the panel 24R and the inside wall panel 24INR of the refrigerated cabinet 24. After the foam 24I hardens fixing the angles 104 in place, the bolts 100 are removed.

Figure 10:
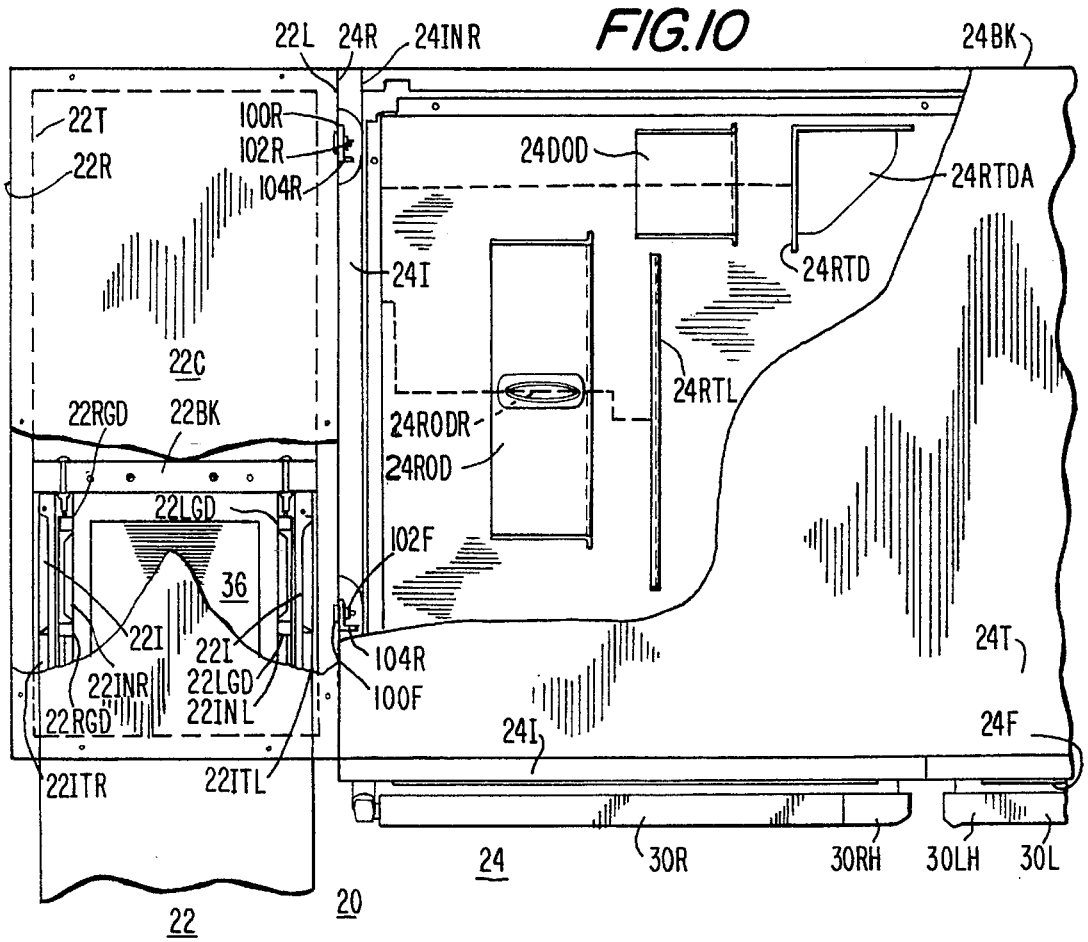
FIG. 10 (sheet three) is a top view of the refrigerator system of FIG. 1 showing the refrigerating mechanism partially removed and its case attached to the refrigerated cabinet, which is partially broken away to show an exploded view of the discharge and return opening ducts that conduct air between the refrigerating mechanism and the refrigerated cabinet.

During attachment of the refrigerating mechanism 22 to the refrigerated cabinet 24, the inside of the refrigerated mechanism 22 is slid out of its case 22C (as shown in Fig. 10) so that the bolts 100 can be screwed in. The bolts 100F are accessed through the front opening of the case 22C and the bolts 100R through the rear opening of the case 22C.

Figure 11:
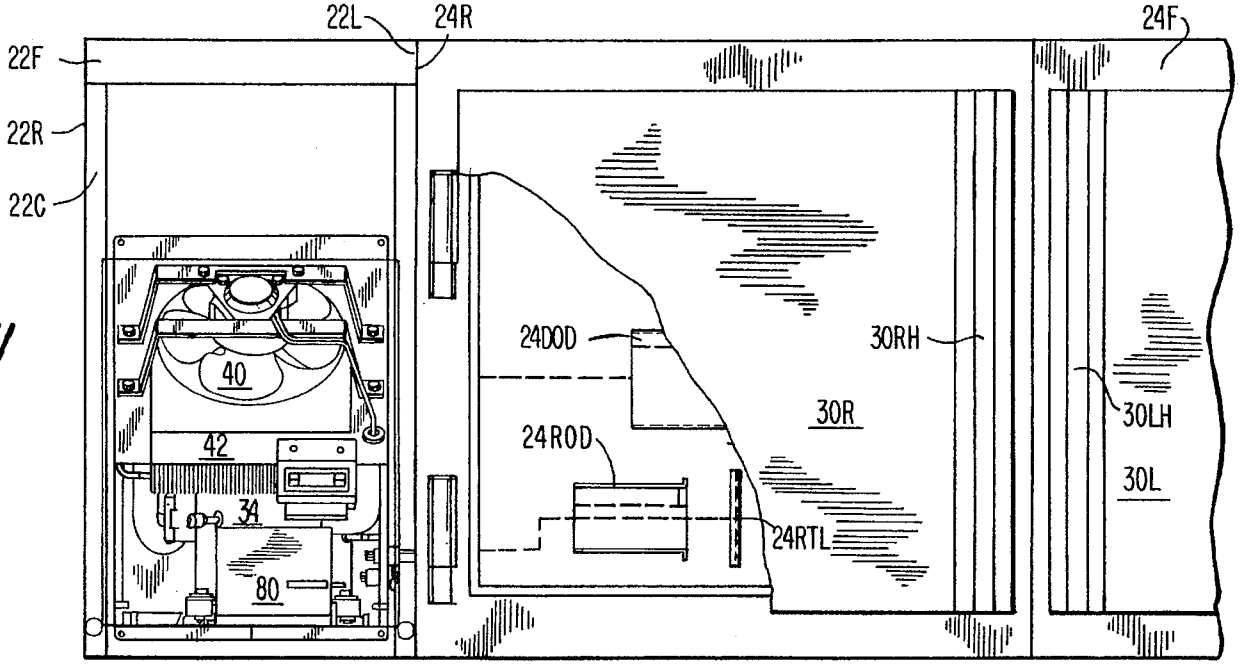
FIG. 11 is a front elevational view of the refrigerator system shown in FIG. 10, partially broken away to show the discharge and return opening ducts.
Figure 12:
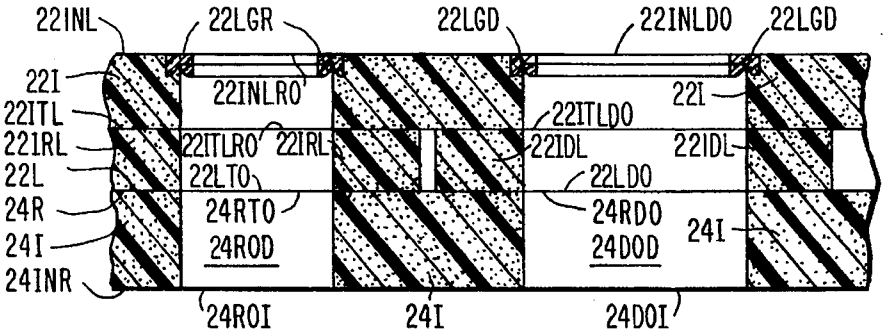
FIG. 12 is an elevational cross-sectional view (turned on its side for convenience) of a cutaway section showing the discharge opening duct (on the right) passing from the inside panel of the refrigerated cabinet (on the bottom) to a matching opening in an interior panel (on the top) adjacent the discharge opening on the left side of the blower shown in FIG. 5L, and the return opening duct (on the left) passing from the inside panel of the refrigerated cabinet to a matching opening in the interior panel. Insulating foam is shown partially hatched.

After the refrigerating mechanism 22 is attached to the refrigerated cabinet 24, a square-shaped plastic discharge opening duct 24DOD (FIGS. 10–12) is inserted from the inside of the refrigerated cabinet 24 through a discharge opening 24DOI (FIG. 12) in the inside wall panel 24INR, through the discharge opening 24RDO (FIGS. 7R and 12) in the right panel 24R, through the discharge opening 22LDO (FIGS. 6L and 12) in the left panel 22L of the refrigerating mechanism 22, through a discharge opening 22ITLDO (FIG. 12) in an inner panel 22ITL (FIGS. 3 and 12) to press against a soft doughnut-shaped gasket 22LGD around the discharge opening 22INLDO in the inner panel 22INL (FIGS. 3 and 12). Discharge opening 22INLDO in inner panel 22INL abuts discharge opening 38OL (FIG. 5L) in blower plenum 38PL.

The discharge opening duct 24DOD (FIG. 12) also passes through matching openings in foam insulation 22I and 24I (FIG. 12): the foam insulation 24I between inside wall panel 24INR and right panel 24R of the refrigerated cabinet 24, through the one-inch thick doughnut-shaped foam seal 22IDL (FIGS. 6L and 12) which is adhered over an inside flange (not shown) surrounding the discharge opening 22LDO in the left panel 22L of the refrigerating mechanism 22, then through the foam insulation 22I (FIG. 12) between inner panel 22ITL and inner panel 22INL.

Then a rectangularly-shaped plastic return opening duct 24ROD (FIGS. 10–12) is inserted from the inside of the refrigerated cabinet 24 through a return opening 24ROI (FIG. 12) in the inside wall panel 24INR, through the return opening 24RTO (FIGS. 7R and 12) in the right panel 24R, through the return opening 22LTO (FIGS. 6L and 12) in the left panel 22L of the refrigerating mechanism 22, through a return opening 22ITLRO (FIG. 12) in the inner panel 22ITL (FIGS. 3 and 12), to press against a soft doughnut-shaped gasket 22LGR around the return opening 22INLRO in the inner panel 22INL (FIGS. 3 and 12). Return opening duct 24ROD has a rib 24RODR (FIG. 10) to prevent its sides from bending inwardly.

The return opening duct 24 ROD also passes through matching openings in foam insulation 22I and 24I (FIG. 12): the foam insulation 24I between inside wall panel 24INR and right panel 24R of the refrigerated cabinet 24, through the one-inch thick doughnut-shaped foam seal 22IRL (FIGS. 6L and 12) which is adhered over an inside flange (not shown) surrounding the discharge opening 22LTO in the left panel 22L of the refrigerating mechanism 22, then through the foam insulation 22I (FIG. 12) between inner panel 22ITL and inner panel 22INL.

Screws (not shown) connect the outer ends of the discharge duct 24DOD and return duct 24ROD to the inside cabinet wall 24INR (FIG. 12).

While FIG. 12 shows the various layers of the refrigerator system 20 through which the discharge duct 24DOD and return duct 24ROD pass when the refrigerating mechanism 22 is mounted on the right side of refrigerated cabinet 24, there is a corresponding arrangement when the refrigerated mechanism 22 is mounted on the left side of the refrigerated cabinet 24, with the letter "R" replaced with the letter "L" in the various character references and vice versa, except for the return duct 24ROD.

The two-part thermal insulating foam 22I and 24I (Fig. 12) and 92 (FIG. 9) is open cell foam of two pound density made from isocynate and resin. The refrigerating mechanism 22 insulation totals 1.5 inches on each side of the plenum 38PL. The refrigerated cabinet 24 insulation totals two inches on each of its sides. The discharge duct 24DOD and return duct 24ROD is made from GPX 3800 grey ABS and are about 4.8 inches long. The sides of the gaskets 22LGD and 22LGR are one inch wide and one-half inch deep and are made from pvc closed cell low compression seven pound density which is compressed down to one-eighth inch by the discharge duct 24DOD and the return duct 24ROD. The doughnut-shaped foam seals 22IR and 22IL are die cut from a sheet of two-pound density open cell foam. All of the panels are 20 gauge galvanized or stainless steel. The inside wall panel 24INR of the refrigerated cabinet 24 is made from stainless steel or aluminum at the customer's option.

In the refrigerating operation, when the refrigerating mechanism 22 is attached to the right side of the refrigerated cabinet 24 (FIG. 1), via discharge duct 24DOD the cooled air is discharged from the discharge outlet 380L (FIG. 5L) of the evaporator blower 38 in the refrigerating mechanism 22, via the matching discharge opening 22RDO (FIG. 6R) in the right panel 22R of the refrigerating mechanism 22, via the matching discharge opening 24RDO (FIG. 7R) in the refrigerated cabinet 24, into the transition duct 24RTD (FIGS. 8R and 10) to the interior of refrigerated cabinet 24. Warmed air is returned through return louver 24RTL, via return duct 24ROD through matching return opening 24RTO (FIG. 7R) in the right side of the refrigerated cabinet 24, and via matching return opening 22RTO (FIG. 6R) in the right panel 22R into the evaporator section 33E (FIG. 2) of the refrigerating mechanism 22.

To move the refrigerating mechanism 22 (FIG. 1) from the right side of refrigerated cabinet 24, as shown, to the left side of refrigerated cabinet 24, the discharge duct 24DOD and return duct 24ROD are unscrewed and removed from the right inside panel of the refrigerated cabinet 24. Then the inside of the refrigerating mechanism 22 is removed from its case 22C (FIG. 10) and the bolts 100 are unscrewed from refrigerated cabinet 24. Then the vanity skirt panel is removed from the right side of the refrigerating mechanism, and the vanity skirt panel is removed from the left side of the refrigerated cabinet 24. Then the insulating foam plugs which blocked the discharge opening 24LDO (FIG. 7L) and the return opening 24LTO in the left side of the refrigerated cabinet 24 are removed and plugged into the discharge opening 24RDO and the return opening 24RTO in the right side of the refrigerated cabinet 24. Then the refrigerating mechanism case 22C is mounted on the left side of the refrigerated cabinet 24 via bolts 100 from the inside of the refrigerating mechanism case 22C. Then the inside of the refrigerating mechanism 22 is mounted in case 22C. Then the discharge duct 24DOD and return duct 24ROD are inserted through, and screwed into, the left inside panel 24INR of the refrigerated cabinet 24. Then the vanity skirt panel that was on the left side of the refrigerated cabinet 24 is mounted on the right side of the refrigerated cabinet 24. Then the vanity skirt panel that was mounted on the right side of the refrigerating mechanism 22 is mounted on the left side of the refrigerating mechanism 22. Finally, the legs 32 are mounted below the outside corners of refrigerating mechanism 22 and refrigerated cabinet 24.

Thus all of the objects and advantages of the invention and its features, as stated at the beginning of this specification, are accomplished.

It is understood that the construction shown and described herein is merely illustrative of the invention and its features and that the invention and its features may be embodied in other forms within the scope of the claims.

What is claimed is:

1. A refrigerator system comprising:

(A) a unitary refrigerated cabinet;

(B) discharge and return openings on each of two opposite vertical sides of said unitary refrigerated cabinet;

(C) a refrigerating mechanism which is separately encased from said unitary refrigerated cabinet;

(D) discharge and return openings on each of two opposite vertical sides of said refrigerating mechanism which correspond with said discharge and return openings on each of two opposite vertical sides of said unitary refrigerated cabinet;

(E) attachment means for attaching said separately encased refrigerating mechanism to either of said two opposite vertical sides of said unitary refrigerated cabinet; and (F) opening cover means for covering the discharge and return openings on each of the unattached sides of said unitary refrigerated cabinet and said refrigerating mechanism.

2. The refrigerator system of claim 1 further comprising:

(G) an evaporator coil mounted in said refrigerating mechanism;

(H) an evaporator blower assemblage mounted adjacent said evaporator coil;

(I) a discharge opening on each of two opposite vertical sides of said evaporator blower assemblage which corresponds with said discharge opening on each of two opposite vertical sides of said refrigerating mechanism.

3. The refrigerator system of claim 2 wherein said evaporator blower assemblage comprises:

(A) a blower;

(B) a blower plenum enclosing the top and sides of said blower;

(C) a discharge opening on each of two opposite vertical sides of said blower plenum which corresponds with said discharge opening on each of two opposite vertical sides of said refrigerating mechanism.

4. The refrigerator system of claim 3 wherein said blower comprises:

(D) a motor;

(E) first and second centrifugal blowers mounted on each side of said motor along the same axis;

(F) each of said first and second centrifugal blowers having vanes.

5. The refrigerator system of claim 4 wherein said blower further comprises:

(D) first and second scrolls is respectively encompassing said first and second centrifugal blowers;

(E) said blower plenum having an inverted U-shape;

(F) each of said first and second scrolls being attached over an opening in the base of said inverted U-shaped blower plenum;

(G) whereby when said motor is rotated, warm air is drawn over said evaporator coil to cool the air, said first and second centrifugal blowers blow said cooled air into said blower plenum via said first and second scrolls, and said cooled air is discharged from one of said discharge openings in said blower plenum through the corresponding discharge opening in the side of said refigerating mechanism into the corresponding discharge opening of said attached unitary refrigerated cabinet.

6. The refrigerator system of claim 1 further comprising:

(A) a removable counter top which matches the top of said unitary refrigerated cabinet;

(B) said removable counter top having a predetermined thickness;

(C) said unitary refrigerated cabinet having a predetermined height;

(D) said refrigerating mechanism case having a predetermined height substantially equal to said predetermined height of said unitary refrigerated cabinet plus said predetermined thickness of said removable counter top;

(E) attaching means for attaching said removable counter top solely to the top of said unitary refrigerated cabinet;

(F) whereby the top plane of said removable counter top is in substantially the same plane as the top of said refrigerating mechanism case.

7. The refrigerator system of claim 6 further comprising:

(G) a condiment container having a predetermined shape and size;

(H) said removable counter top having an opening which matches said predetermined shape and size of said condiment container and is adapted to receive said condiment container.

8. The refrigerator system of claim 7 wherein said removable counter top comprises a metallic shell filled with an insulating foam.

9. The refrigerator system of claim 8 wherein said metallic shell is galvanized steel on the outside and stainless steel on the inside.

10. The refrigerator system of claim 1 wherein said refrigerating mechanism comprises:

(A) an evaporator section;

(B) a compressor section;

(C) an insulating wall separating said evaporator section and said compressor section;

(D) an evaporator coil mounted in said evaporator section of said refrigerating mechanism;

(E) a first condensate container mounted beneath said evaporator coil to contain water condensed on the outside of said evaporator coil;

(F) a compressor mounted in said compressor section of said refrigerating mechanism;

(G) a condenser coil mounted adjacent said compressor;

(H) a condenser fan mounted adjacent said condenser coil and adapted to force air through said condenser coil and around said compressor to cool said condenser coil and compressor;

(I) a second condensate container mounted in said compressor section below at least part of said compressor, the bottom of said second condensate container being below the bottom of said first condensate container;

(J) condensate conduit means for conducting condensate in said first condensate container through said insulating wall and into said second condensate container;

(K) enclosure means for enclosing said compressor section on all sides except for one side;

(L) a panel on said one side of said compressor section having a top opening adjacent its top and a bottom opening adjacent its bottom;

(M) said condenser fan forcing air drawn through said top opening of said panel, through said condenser coil to warm the forced air, around said compressor to further warm the forced air, then over said condensate in said second condensate container to evaporate said condensate, and then expel said evaporated condensate in the forced air out said bottom opening of said panel.

11. A refrigerator system according to claim 10 wherein said panel is the front panel of said compressor section.

12. A refrigerator system comprising:

(A) an evaporator section;

(B) a compressor section adjacent said evaporator section;

(C) an insulating wall separating said evaporator section and said compressor section;

(D) an evaporator coil mounted in said evaporator section;

(E) a first condensate container mounted beneath said evaporator coil to contain water condensed on the outside of said evaporator coil;

(F) a compressor mounted in said compressor section;

(G) a condenser coil mounted adjacent said compressor;

(H) a condenser fan mounted adjacent said condenser coil and adapted to force air through said condenser coil and around said compressor to cool said condenser coil and said compressor;

(I) a second condensate container mounted in said compressor section below at least part of said compressor, the bottom of said second condensate container being below the bottom of said first condensate container;

(J) condensate conduit means for conducting condensate in said first condensate container through said insulating wall into said second condensate container;

(K) enclosure means for enclosing said compressor section on all sides except for one side;

(L) a panel on said one side of said compressor section having a top opening adjacent its top and a bottom opening adjacent its bottom;

(M) said condenser fan forcing air drawn through said top opening of said panel, through said condenser coil to warm the forced air, around said compressor to further warm the forced air, then over said condensate in said second condensate container to evaporate said condensate, and then expel said evaporated condensate in the forced air out said bottom opening of said panel.

13. A refrigerator system according to claim 12 wherein said panel is the front panel of said compressor section.

14. The refrigerator system of claim 12 wherein said condenser coil and said condenser fan are mounted at a predetermined angle from the horizontal plane in said compressor section.

15. The refrigerator system of claim 14 wherein said predetermined angle is substantially 45°.

16. The refrigerator system of claim 12 wherein said condenser fan produces a forced air stream in the range of 350 to 450 cubic feet per minute.

17. The refrigerator system of claim 15 wherein said condenser fan produces a forced air stream in the range of 350 to 450 cubic feet per minute.

18. The refrigerator system of claim 1 wherein:

(G) said discharge and return openings on each of said two opposite vertical sides of said unitary refrigerated cabinet are in outside and inner panels of said unitary refrigerated cabinet separated by thermal insulation having corresponding discharge and return openings;

(H) said discharge and return openings on each of said two opposite vertical sides of said refrigerating mechanism are in outside and inner panels of said refrigerating mechanism separated by thermal insulation having corresponding discharge and return openings.

19. The refrigerator system of claim 18 further comprising:

(I) a discharge opening duct passing through each of said discharge openings from the inside of said unitary refrigerated cabinet to the inside of said refrigerating mechanism;

(J) a return opening duct passing through each of said return openings from the inside of said unitary refrigerated cabinet to the inside of said refrigerating mechanism.

20. The refrigerator system of claim 19 wherein:

(K) the inside end of said discharge opening duct presses against a compressible gasket surrounding the discharge opening in said inner panel of said refrigerating mechanism.

21. The refrigerator system of claim 1 further comprising:

(G) a removable counter top which matches the top of said unitary refrigerated cabinet;

(H) said removable counter top having a predetermined thickness;

(I) said unitary refrigerated cabinet having a predetermined height;

(J) said refrigerating mechanism case having a predetermined height substantially equal to said predetermined height of said unitary refrigerated cabinet plus said predetermined thickness of said removable counter top;

(K) attaching means for attaching said removable counter top to the top of said unitary refrigerated cabinet;

(L) whereby the top plane of said removable counter top is in substantially the same plane as the top of said refrigerating mechanism case;

(M) an evaporator section of said refrigerating mechanism;

(N) a compressor section of said refrigerating mechanism;

(O) an insulating wall separating said evaporator section and said compressor section;

(P) an evaporator coil mounted in said evaporator section of said refrigerating mechanism;

(Q) a first condensate container mounted beneath said evaporator coil to contain water condensed on the outside of said evaporator coil;

(R) a compressor mounted in said compressor section of said refrigerating mechanism;

(S) a condenser coil mounted adjacent said compressor;

(T) a condenser fan mounted adjacent said condenser coil and adapted to force air through said condenser coil and around said compressor to cool said condenser coil and compressor;

(U) a second condensate container mounted in said compressor section below at least part of said compressor, the bottom of said second condensate container being below the bottom of said first condensate container;

(V) condensate conduit means for conducting condensate in said first condensate container through said insulating wall and into said second condensate container;

(W) enclosure means for enclosing said compressor section on all sides except for one side;

(X) a panel on said one side of said compressor section having a top opening adjacent its top and a bottom opening adjacent its bottom;

(Y) said condenser fan forcing air drawn through said top opening of said panel, through said condenser coil to warm the forced air, around said compressor to further warm the forced air, then over said condensate in said second condensate container to evaporate said condensate, and then expel said evaporated condensate in the forced air out said bottom opening of said panel.

* * * * *